US011712702B2

(12) United States Patent
De Melo

(10) Patent No.: US 11,712,702 B2
(45) Date of Patent: Aug. 1, 2023

(54) CENTRIFUGAL SEPARATION CHAMBER

(71) Applicant: Biosafe S.A., Eysins (CH)

(72) Inventor: Daniel De Melo, Eysins (CH)

(73) Assignee: Biosafe S.A., Eysins (CH)

( * ) Notice: Subject to any disclaimer, the term of this patent is extended or adjusted under 35 U.S.C. 154(b) by 411 days.

(21) Appl. No.: 16/641,478

(22) PCT Filed: Aug. 30, 2018

(86) PCT No.: PCT/EP2018/073337
§ 371 (c)(1),
(2) Date: Feb. 24, 2020

(87) PCT Pub. No.: WO2019/043093
PCT Pub. Date: Mar. 7, 2019

(65) Prior Publication Data

US 2020/0230614 A1 Jul. 23, 2020

(30) Foreign Application Priority Data

Aug. 31, 2017 (GB) ..... 1713981

(51) Int. Cl.
*B04B 5/04* (2006.01)
*B04B 7/08* (2006.01)

(52) U.S. Cl.
CPC ..... *B04B 5/0428* (2013.01); *B04B 5/0442* (2013.01); *B04B 7/08* (2013.01)

(58) Field of Classification Search
CPC ..... B04B 5/0428; B04B 5/0442; B04B 7/08; B04B 2005/0485
See application file for complete search history.

(56) References Cited

U.S. PATENT DOCUMENTS 3,239,136 A 3/1966 Hein
3,297,244 A 1/1967 Hein
5,188,583 A 2/1993 Guigan
(Continued)

FOREIGN PATENT DOCUMENTS

CN 103657756 A 3/2014
WO 2015080918 A1 6/2015

OTHER PUBLICATIONS

Chinese Office Action for CN Application No. 201880056452.8 dated Jun. 30, 2021 (21 pages, with English translation).
(Continued)

*Primary Examiner* — Timothy C Cleveland
(74) *Attorney, Agent, or Firm* — Eversheds Sutherland (US) LLP

(57) ABSTRACT

Disclosed is a centrifugal separation chamber (100) rotatable about an axis (AR) and having a variable volume separation space (116) therewithin and a port (102) in fluid communication with the volume for filling and emptying the volume, the chamber including a relatively rigid portion (104) proximal to the port which has walls defining a part of the volume and arranged to provide reducing dimensions of the volume toward the port, the chamber further including a flexible portion (106) distal to the port for providing said variable volume, the flexible portion including a mechanical interface (110) for transmitting movement to the flexible portion to cause said variable volume.

20 Claims, 3 Drawing Sheets

(56) References Cited

U.S. PATENT DOCUMENTS

| | | | | |
|---|---|---|---|---|
| 5,728,040 | A * | 3/1998 | Schill | B04B 5/0442 494/67 |
| 6,733,433 | B1 | 5/2004 | Fell | |
| 7,241,281 | B2 | 7/2007 | Coelho et al. | |
| 8,870,733 | B2 * | 10/2014 | Nash | B01D 21/262 494/3 |
| 2007/0213191 | A1 | 9/2007 | Chammas | |
| 2015/0068959 | A1 | 3/2015 | Zheng | |

OTHER PUBLICATIONS

PCT International Search Report and Written Opinion for PCT Application No. PCT/EP2018/073337 dated Nov. 13, 2018 (9 pages).
Great Britain Search Report for GB Application No. 1713981.7 dated Feb. 21, 2018 (3 pages).

* cited by examiner

CENTRIFUGAL SEPARATION CHAMBER

CROSS REFERENCE TO RELATED APPLICATIONS

This application claims the priority benefit of PCT/EP2018/073337 filed on Aug. 30, 2018, which claims priority benefit of Great Britain Patent Application No. 1713981.7 filed on Aug. 31, 2017, the entire contents of which are hereby incorporated by reference herein.

FIELD OF THE INVENTION

The present invention relates to the separation of fluids into their component parts, for example biological fluids such as separation of whole blood, apheresis blood, or bone marrow blood into red blood cells, white blood cells, platelets and plasma, and separating suspensions of cells for example or stem cells expanded in number through culturing techniques and/or separation of certain cell populations like hematopoietic stem cells from other cells. In particular, the invention relates to a chamber for centrifugal separation of such fluids or suspensions.

BACKGROUND OF THE INVENTION

Blood separation systems and methods have emerged over the past 20 years in response to the growing need for efficient blood component therapies, which require the separation of stem cells from remaining blood components, for immediate use, for genetic modification and then their use, or storage for later use, for example after chemotherapy.

IN a typical separation process, the components of blood, i.e. red blood cells, white blood cells, platelets and plasma are used for different therapies and therefore a certain amount of blood is processed in order to separate out these components. The blood is collected into a blood collection bag containing an anticoagulant solution. The collected blood is separated into its sub-components by spinning the blood bag for a period of about 10 minutes in a large refrigerated centrifuge. Following centrifugation, each of the components are expressed sequentially from the blood collection bag into separate collection bags.

There has been a desire for more automated, compact and portable systems for collection and separation of biological fluids, that are suitable even for processing relatively small volumes. U.S. Pat. Nos. 3,737,096, 4,303,193 propose a relatively small centrifugal apparatus attached to collapsible bags. However, these devices have a minimum fixed holding volume which requires a minimum volume usually of about 250 mL to be processed before any components can be collected.

U.S. Pat. No. 5,316,540 discloses a centrifugal processing where the processing chamber is a flexible processing bag which can be deformed hydraulically to fill it with biological fluid or empty it.

EP0654669-A discloses a centrifugal processing apparatus having two chambers separated by a piston. Before centrifugation, a small quantity of fluid to be processed is taken in via an off-centre inlet, and is transferred between the two chambers during centrifugal processing.

A functionally closed system for the separation blood constituents is described in U.S. Pat. Nos. 6,123,655, 6,733,433 the contents of which are incorporated herein by reference. U.S. Pat. No. 6,123,655 teaches a portable and disposable centrifugal apparatus with a processing chamber of variable volume. It can therefore process a variable quantity of biological fluid, even down to very small quantities. U.S. Pat. No. 6,733,433 describes a similar apparatus. Both of these documents teach control of the movement of a sliding piston by means of a pneumatic system located at the bottom of the chamber that selectively creates either a vacuum or a positive pressure to move the piston up or down as desired.

Those patents propose a system for the processing and separation of biological fluids into components, comprising a set of containers for receiving the biological fluid to be separated and the separated components, and optionally one or more additional containers for additive solutions. A hollow centrifuge processing chamber is rotatable about an axis of rotation by engagement of the processing chamber with a rotary drive unit. The processing chamber has an axial inlet/outlet for biological fluid to be processed and for processed components of the biological fluid. This inlet/outlet leads into a separation space of variable volume wherein the entire centrifugal processing of biological fluid takes place. The processing chamber comprises a generally cylindrical wall extending from an end wall of the processing chamber, this generally cylindrical wall defines therein the hollow processing chamber which occupies a hollow open cylindrical space coaxial with the axis of rotation, the axial inlet/outlet being provided in said end wall coaxial with the generally cylindrical wall to open into the hollow processing chamber. The processing chamber contains within the generally cylindrical wall an axially movable piston. The separation space of variable volume is defied in an upper part of the processing chamber by the generally cylindrical wall and by the piston in the processing chamber. The separation space is in fluid communication with the inlet/outlet. Axial movement of the movable member varies the volume of the separation space, to introduce or expel a selected quantity of biological fluid to be processed into or out of the separation space via the inlet/outlet before, during or after centrifugal processing and to express processed biological fluid components from the separation space via the outlet during or after centrifugal processing.

The piston is operable to vary the separation space by means of a pneumatic pressure differential on the side of the piston opposite to the separation space, which is a generally closed volume. Clean air is pumped into or out of this closed volume to induce movement of the piston to vary the separation space volume and in turn to induce fluid flow into or out of the separation space.

Whilst this mechanism works well, the inventor has realised that improvements could be made in the arrangement mentioned above. It is found that the piston, which in practice has elastomeric sealing ring around its periphery, has a tenancy to remain stationary until a sufficient pressure differential has been generated, at which point the piston jerks into movement initially. Thus, small and steady changes in the separation space volume are difficult to achieve. Also, the fluid to be processed comes into contact with the cylindrical wall of the separation chamber which was once on the opposite side of the piston, with the result that a potential contamination route is possible between the air used to move the piston and the fluids to be separated in the chamber. In practice the air used to move the piston is filtered and sterile, nevertheless, it is a contamination risk. Small particles abraded from the cylinder wall or shed from the sliding piston and seals can also collected in the fluid in the separation space.

SUMMARY OF THE INVENTION

Embodiments of the invention address the problems mentioned above. According to one aspect the invention provides a centrifugal separation chamber having a variable volume separation space therewithin and a port in fluid communication with the volume for filling and emptying the volume, the chamber including a relatively rigid portion proximal to the port which has walls defining a part of the volume and arranged to provide reducing dimensions of the volume toward the port, the chamber further including a flexible portion distal to the port for providing said variable volume, the flexible portion including a mechanical interface for transmitting movement to the flexible portion to cause said variable volume.

Thereby, the separation chamber proposed by the inventor eliminates sliding parts and piston seals, which reduces contamination risk and the risk of shedding particles into fluids in the chamber, as well as providing an easily controllable high resolution volume change with little disturbance of the separated constituents when the chamber is emptied.

In an embodiment, the rigid portion supports the flexible portion, the rigid portion defining a cross sectional area transverse to an axis of intended rotation of the chamber which progressively decreases in area closer to the port.

In an embodiment, the rigid portion is conical or pyramidal or another shape, all tapering toward the port.

In an embodiment, the chamber includes an area or areas which is/are furthest away from said axis, and that/those area(s) include a discrete conduit leading to the port.

In an embodiment, the rigid portion may include a rotatable seal adjacent to the port for allowing rotation of the chamber at the same time as a fluid tight connection to a stationary fluid conduit.

In an embodiment, the rigid portion and the flexible element are held together in a fluid tight manner, for example by means of a clamping ring for compressing the flexible member against the rigid portion and having complementary formations which clamp the flexible element between ring and the rigid portion in a fluid tight manner.

In an embodiment, the flexible member is a formed from an elastomer, for example: Natural polyisoprene-cis-1,4-polyisoprene natural rubber (NR) and trans-1,4-polyisoprene gutta-percha; Synthetic polyisoprene (IR for isoprene rubber); Polybutadiene (BR for butadiene rubber); Chloroprene rubber (CR), polychloroprene; Butyl rubber (copolymer of isobutylene and isoprene, IIR); Halogenated butyl rubbers (chloro butyl rubber: CIIR; bromo butyl rubber: BIIR); Styrene-butadiene Rubber (copolymer of styrene and butadiene, SBR); Nitrile rubber (copolymer of butadiene and acrylonitrile, NBR); Hydrogenated Nitrile Rubbers (HNBR); EPM (ethylene propylene rubber, a copolymer of ethylene and propylene); EPDM rubber (ethylene propylene diene rubber, a terpolymer of ethylene, propylene and a diene-component); Epichlorohydrin rubber (ECO); Polyacrylic rubber (ACM, ABR); Silicone rubber (SI, Q, VMQ); Fluorosilicone Rubber (FVMQ); Fluoroelastomers (FKM, and FEPM); Perfluoroelastomers (FFKM); Polyether block amides (PEBA); Chlorosulfonated polyethylene (CSM), (Hypalon); Ethylene-vinyl acetate (EVA), or composites or combinations thereof.

The rigid portion and/or the clamping ring may be formed from a plastics moulded material, for example a transparent or translucent plastics, for example, Polyethylene terephthalate (PETE or PET); Polyethylene (PE); Polyvinyl Chloride (PVC); Polypropylene (PP); Polystyrene (PS); Polylactic Acid (PLA); Polycarbonate (PC); Acrylic (PMMA) or composites or combinations thereof.

According to a second aspect the invention comprises a biological centrifugal separation system including a separation chamber according to the first aspect and a chamber rotation mechanism for spinning the chamber at a sufficient rotational velocity to separate biological components held in the chamber in use, the system further including a drive for transmitting movement having a linear component to the separation chamber via said mechanical interface to cause said varying volume.

In an embodiment, the drive may comprise a mechanical, electrical, pneumatic or hydraulic actuator, or combinations thereof.

In an embodiment, where a mechanical actuator is used, the actuator may include a rack held to said interface, the rack being in operative association with a pinion rotatable in use to move the rack and to thereby move the flexible element to change the separation volume.

In an embodiment, the flexible element comprises a membrane operable when pushed by the mechanical interface to form a shape approximating to the inner tapering shape of chamber, thereby to reduce the chamber volume substantially to zero if needed.

The invention extends to use of the system above in a method for the separation of a biological fluid into its components wherein said method comprises:

a) transferring a biological fluid from a container into the separation volume of the separation chamber by moving said flexible portion;

b) operating said rotation mechanism to rotate the separation chamber at a speed suitable for centrifugal separation of the biological fluid within the separation volume to obtain one or more separated components of said biological fluid;

c) further transferring the or each separated component from said separation volume into one or more output containers by selective opening of one or more valves; the method being characterised in that the transferring step and further transferring step are effected by changing the volume of the separating volume by moving a flexible portion of the chamber in turn by means of a mechanical interface connected to the flexible portion.

In an embodiment, said biological fluid is blood e.g. umbilical cord blood, or a liquid cell culture, and the one or more components include one or more of plasma, stem cells and red blood cells.

Any combination of the abovementioned features are intended to fall within the ambit of the invention.

BRIEF DESCRIPTION OF THE DRAWINGS

The invention will be further described by way of example with reference to the accompanying drawings, wherein:

Referring to FIG. 1 there is shown a separation system 10, which in practice would be used in the same manner as described in EP0912250, for example replacing the components shown in FIG. 3 of that disclosure. Thus, the system includes a fluid supply container 12 such as a blood bag, one or more fluid output containers 14, interconnecting tubing 16, a switching valve 18 and a centrifugal separating chamber 100 fluidically connected to the containers 12 or 14 selectively via the switching valve 18.

Figure 1:
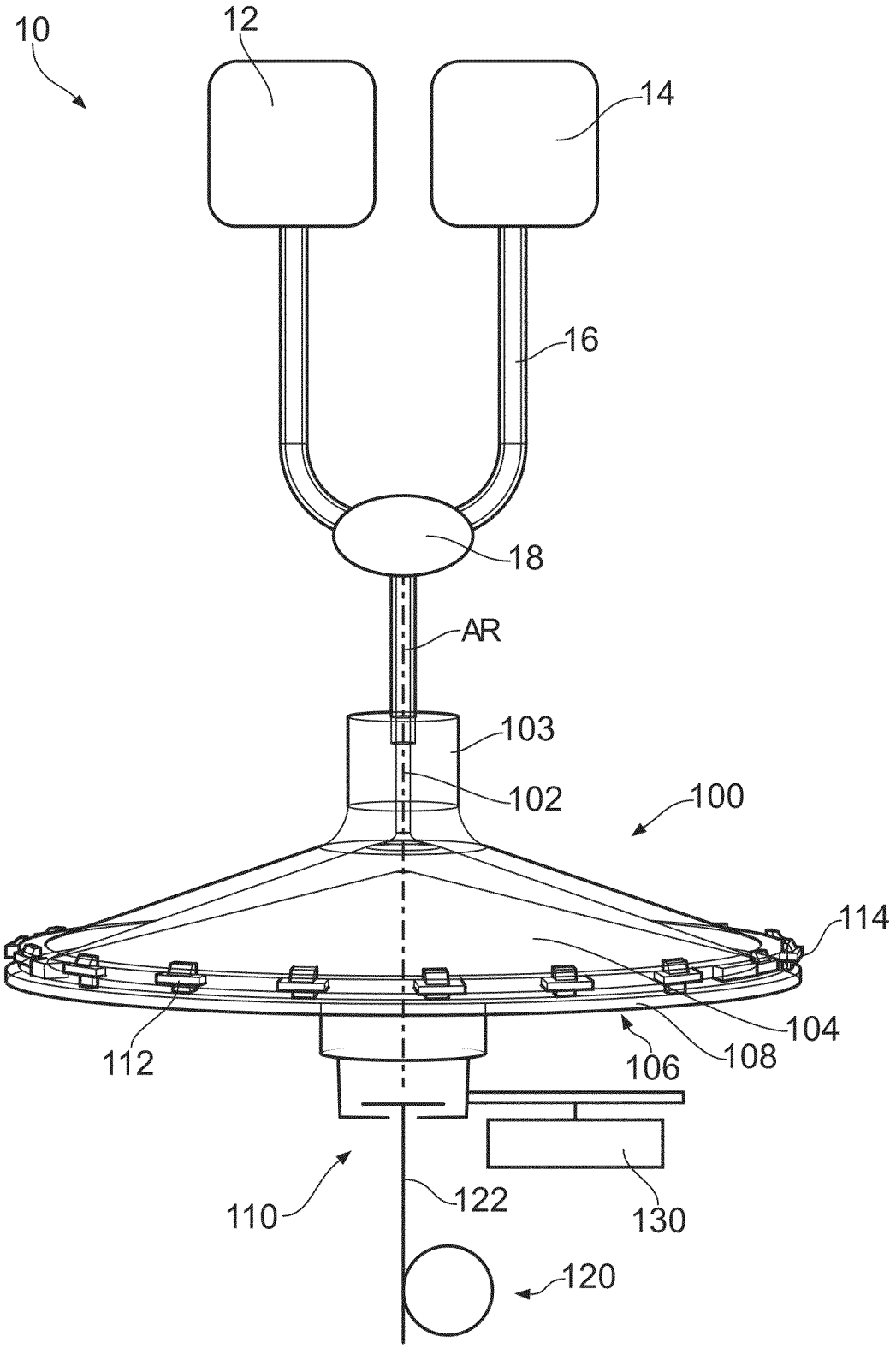
FIG. 1 shows a pictorial view of one embodiment of a variable volume separation system.

That arrangement is generally known, but the construction of the separating chamber assembly 100 illustrated is novel and comprises a rigid hollow upper portion 104, having an inner area which tapers upwardly, formed in this instance, as a truncated hollow cylindrical cone and having a smooth internal transition into a port 102 at a neck portion. The neck portion includes a rotatable fluid coupling 103, for connecting to the stationary tubing 16 for said fluidic connection, and allowing the assembly 100 to rotate. A lower flexible portion 106 in this instance in the form of an elastomeric flexible membrane element is clamped to the upper portion 104 in a fluid tight manner, at a lower periphery 114 of the upper portion 104 by a clamping ring 108 which compresses a lip of the flexible membrane between the ring 108 and the lower periphery 114. The ring 108 is held to the lower periphery by means of complementary snap-fit fastenings 112.

The flexible member 106 extends across the periphery 114 to close the volume formed by the upper portion 104, and includes a mechanical interface 110 which allows pushing and pulling force to be exerted on the membrane, but allowing also rotation of the chamber 100 at the same time about an axis AR. In this case the interface is a simple internal annulus. In this instance, a non-rotatable connecting rod 122 having a head which is accommodated inside the annulus is connected to a rack and pinion drive 120 for said pushing and pulling. The connecting rod and drive 120 are not part of the chamber assembly 100.

Figure 2A:
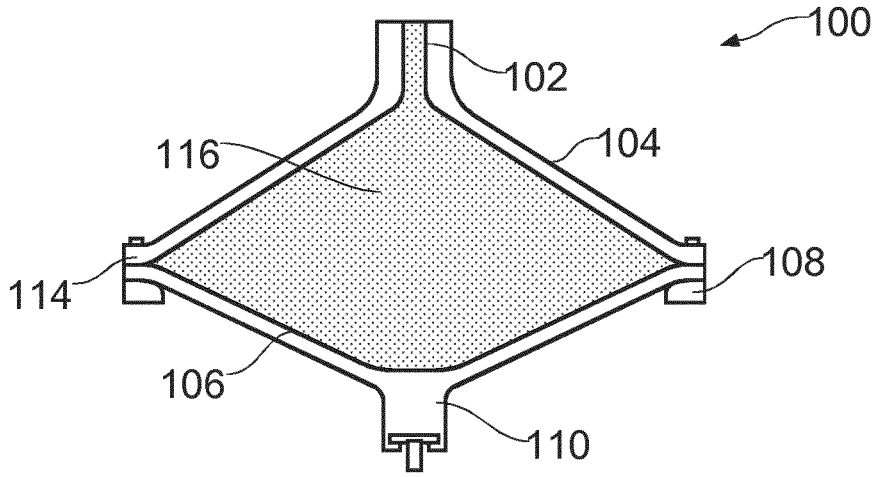
FIGS. 2*a*, 2*b* and 2*c* show a schematic section through the separation chamber illustrated in FIG. 1.
Figure 2B:
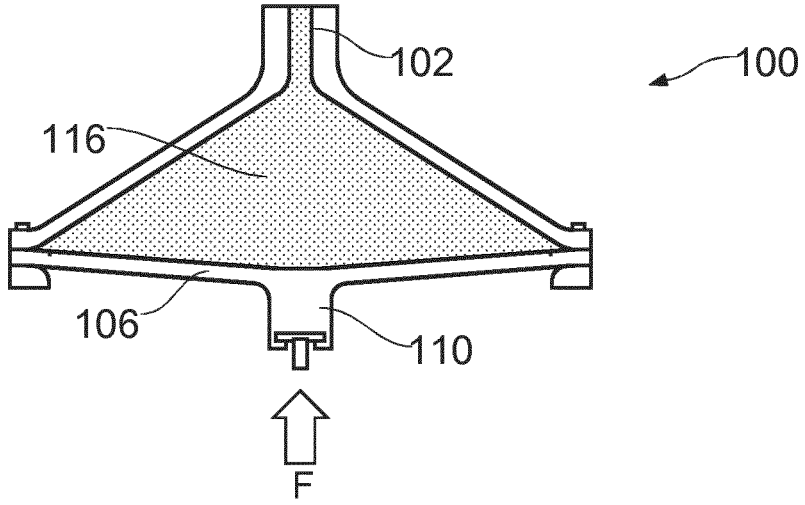
Figure 2C:
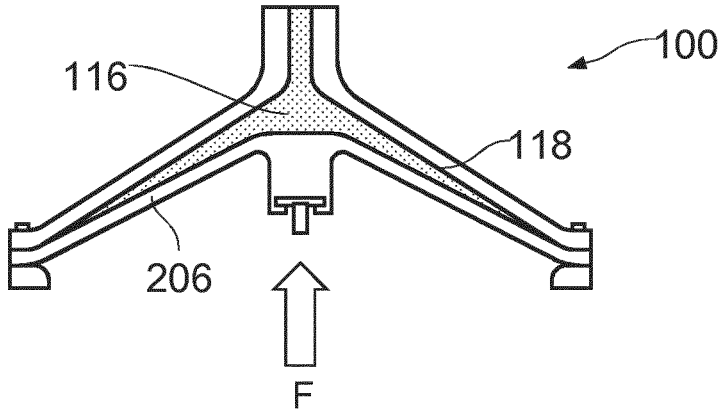

FIGS. 2*a*, 2*b* and 2*c* show schematically, the chamber assembly in three different configurations. In FIG. 2*a* the membrane 106 is in a lowered condition, meaning that the volume 116 of the chamber 100 which in use is spun to separate constituents of fluids within it, is maximised. The clamping ring 108 and alternative fastening means 112 are more clearly visible in this illustration, clamping the membrane 106 in place at the periphery 114 of the rigid portion 104 of the chamber. In FIG. 2*b* the membrane 106 has been pushed upwardly in the direction if arrow F via the mechanical interface 110. In this condition the volume 116 of the chamber is reduced compared to that shown in FIG. 2*a*. In FIG. 2*c*, the membrane 106 has been pushed even further in the direction of arrow F to reduce further the volume 116 in the chamber 100.

In use the chamber will start a process in the condition shown in FIG. 2*c*, and then the membrane is moved progressively to the position shown in FIG. 2*b* and then into the position sown in FIG. 2*a*, by means of an actuator acting on the mechanical interface 110 in a direction opposite to the arrow F, so that fluid is drawn into the volume 116 from the supply container 12 via the port 102. The chamber is spun, and separated constituents and then forced out of the chamber in generally distinct fractions into one or more fraction collection output containers 14 via the port 102 following a route selected via valve 18, all as a result of movement of the membrane under the influence of forces exerted by an actuator, this time, acting in the direction of arrow F. Advantageously the membrane can, if needed conform to the exact shape of an inner wall 118 (FIG. 2*c*) of the upper portion 104 such that virtually all the constituents can be expelled from the separation chamber 100. And further, the membrane will push against a lowermost portion of the said inner wall first meaning that a gradual, non-turbulent, and low shear complete emptying of the chamber constituents is possible.

Figure 3:
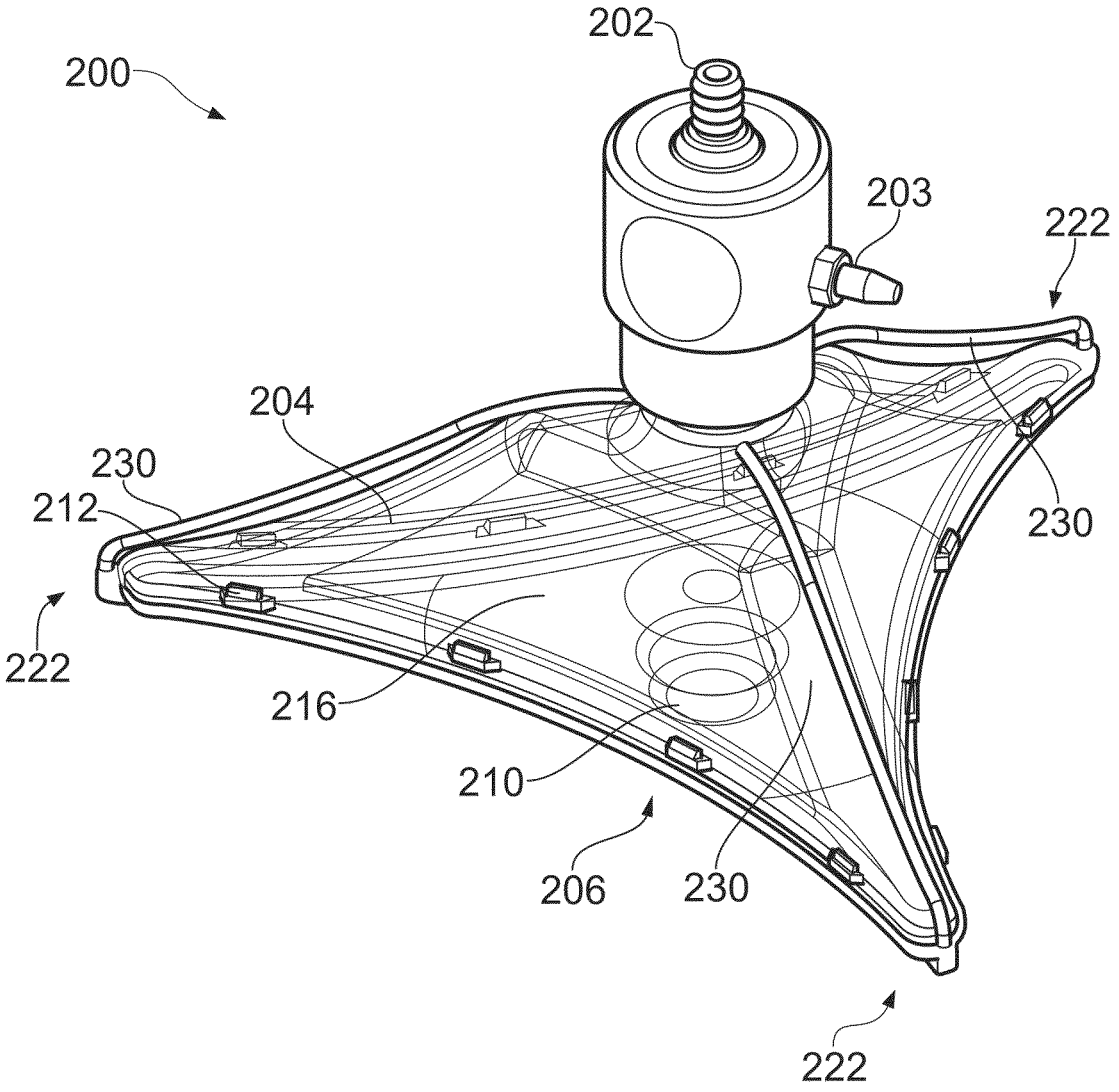
FIG. 3 shows a pictorial view another embodiment of a separation chamber.

FIG. 3 shows an alternative chamber arrangement 200 with any components similar to the components of the chamber shown in FIG. 1 having the same last two reference digits, and not necessarily described again. The chamber 200 is pyramidal in shape, in this case a generally tetrahedron shape with a triangular base. However, to aid the concentration, and extraction of cells within a variable separation volume 216 the chamber faces are convex, resulting in relatively narrow and extended extremity areas 222 where the faces meet and at which cells settle and stratify during centrifugation. The extended areas 222 are internally curved to provide a smooth transition from one face of the pyramid to the other. At these areas 222, conduits 230 providing discrete fluid channels extending from those extremities 222 to a discrete exit port 203. These conduits 230 are provided to exact the heaviest constituents of the separated fluid first, for example when separating cells from a cell culture. The generally smooth internal surfaces of the chamber volume 216 together with a flexible membrane 206 operable in the same manner as described above provide for low shear, gentle manipulation of cells where after centrifugal cell separation is employed. Dead volume in the chamber is to reduced and purity and better separation of cells collected is enhanced, because the cell are concentrated in one area (222) as they are removed, sequentially, if different cell types are to be collected. It will be appreciated that the fewer or more then the three extremities 222 illustrated may be utilised, but three appears to be the most suitable number because two extremities induces vibrations in use, and more than three extremities increases dead volume.

Whilst embodiments of the invention have been described above, to enable any person skilled in the art to practice the invention, including making and using any devices or systems and performing any incorporated methods, it will be apparent that additions to, omissions from and variants of particular features of the embodiments are possible. For example, at least the upper portions 104 and 204 of the chambers 100 and 200 are intended to moulded from transparent plastics so that the separation process can be observed by eye, camera or a light sensor, e.g. a UV sensor sensing the amount of UV light passing through the chamber, or an IR sensor for temperature control. However, other manufacturing techniques could be employed, such as sheet material pressing, casting, machining or additive printing, and other materials could be employed, such as sheet metals, ceramics e.g. glass, or composite plastics. The flexible parts 106, 206 of the chambers 100, 200 are intended to be moulded from an elastomer, but could also be formed by cutting from a flexible sheet material.

The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. Where features are described collectively, those features may be claimed separately without adding to the content of the invention as claimed, and conversely, where features are described separately, their combination in the claims is not intended to add material to the content of the invention as claimed. All patents and patent applications mentioned in the text are hereby incorporated by reference in their entireties, as if they were individually incorporated.

The invention claimed is:

1. A centrifugal separation chamber rotatable about an axis (AR) and having a variable volume separation space therewithin and a port in fluid communication with the volume for filling and emptying the volume, the chamber comprising:

a relatively rigid portion proximal to the port which has walls defining a part of the volume and arranged to provide reducing dimensions of the volume toward the port; and a flexible portion distal to the port for providing said variable volume, the flexible portion including a mechanical interface for transmitting movement to the flexible portion to cause said variable volume, wherein the flexible portion is configured to circumferentially bend only at a central region of the flexible portion at the mechanical interface and bend at a peripheral region immediately adjacent a circumferential edge of the flexible portion without bending between the central region and the peripheral region in response to movement of the mechanical interface.

2. The chamber as claimed in claim 1, wherein the rigid portion supports the flexible portion, the rigid portion defining a cross sectional area transverse to the axis which progressively decreases in area closer to the port.

3. The chamber as claimed in claim 1, wherein the rigid portion is shaped to taper toward the port.

4. The chamber as claimed in claim 3, wherein the flexible portion comprises a membrane a) forming a sterile barrier and/or b) operable when forced by the mechanical interface to form a shape approximating to the inner tapering shape of the relatively rigid portion, thereby to reduce the chamber volume.

5. The chamber as claimed in claim 1, wherein the chamber includes an area or areas which is/are furthest away from said axis, and that/those area(s) include a discrete conduit leading to the port or another exit of the chamber.

6. The chamber as claimed in claim 1, wherein the rigid portion includes a rotatable seal adjacent the port for allowing rotation of the chamber at the same time as a fluid tight connection to a stationary fluid conduit.

7. The chamber as claimed in claim 1, wherein the rigid portion and the flexible portion are held together in a fluid tight manner by means of a clamping ring for compressing the flexible member against the rigid portion and having complementary formations which clamp the flexible element between the clamping ring and the rigid portion in a fluid tight manner.

8. The chamber as claimed in claim 1, wherein, the flexible portion is a formed from an elastomer, selected from: Natural polyisoprene-cis-1,4-polyisoprene natural rubber (NR) and trans-1,4-polyisoprene gutta-percha; Synthetic polyisoprene (IR for isoprene rubber); Polybutadiene (BR for butadiene rubber); Chloroprene rubber (CR), polychloroprene; Butyl rubber (copolymer of isobutylene and isoprene, IIR); Halogenated butyl rubbers (chloro butyl rubber: CIIR; bromo butyl rubber: BIIR); Styrene-butadiene Rubber (copolymer of styrene and butadiene, SBR); Nitrile rubber (copolymer of butadiene and acrylonitrile, NBR); Hydrogenated Nitrile Rubbers (HNBR); EPM (ethylene propylene rubber, a copolymer of ethylene and propylene); EPDM rubber (ethylene propylene diene rubber, a terpolymer of ethylene, propylene and a diene-component); Epichlorohydrin rubber (ECO); Polyacrylic rubber (ACM, ABR); Silicone rubber (SI, Q, VMQ); Fluorosilicone Rubber (FVMQ); Fluoroelastomers (FKM, and FEPM); Perfluoroelastomers (FFKM); Polyether block amides (PEBA); Chlorosulfonated polyethylene (CSM), (Hypalon); Ethylene-vinyl acetate (EVA), and composites or combinations thereof.

9. The chamber as claimed in claim 1, wherein the rigid portion is formed from a plastics moulded material, selected from a transparent or translucent plastics.

10. A biological centrifugal separation system comprising:

a separation chamber as claimed in claim 1;

a chamber rotation mechanism for spinning the chamber at a sufficient rotational velocity to separate biological components held in the chamber in use; and a drive for transmitting movement having a linear component to the separation chamber via said mechanical interface to cause said varying volume.

11. The system as claimed in claim 10, wherein the drive comprises a mechanical, electrical, pneumatic or hydraulic actuator, or combinations thereof.

12. The system as claimed in claim 10, wherein the drive comprises a mechanical actuator including a rack held to said interface, the rack being in operative association with a pinion rotatable in use to move the rack and to thereby move the flexible portion to accurately change the separation volume.

13. A method for the separation of a biological fluid into its components, wherein said method comprises:

a) transferring a biological fluid from a container into the separation volume of the separation chamber of the system of claim 10 by moving said flexible portion;

b) operating said chamber rotation mechanism to rotate the separation chamber at a speed suitable for centrifugal separation of the biological fluid within the separation volume to obtain one or more separated components of said biological fluid;

c) further transferring the or each separated component from said separation volume into one or more output containers by selective opening of one or more valves, wherein the transferring step and further transferring step are effected by changing the volume of the separating volume by moving the flexible portion of the chamber in turn by means of the mechanical interface connected to the flexible portion.

14. The method as claimed in claim 13, wherein said biological fluid is blood or a liquid cell culture.

15. The method as claimed in claim 13, wherein the one or more components include one or more of plasma, stem cells and red blood cells.

16. The chamber as claimed in claim 1, wherein the flexible portion is secured to the relatively rigid portion at the peripheral region of the flexible portion.

17. The chamber as claimed in claim 3, wherein the rigid portion has a cone shape or pyramid shape.

18. The system as claimed in claim 9, wherein the plastics moulded material comprises one or more of polyethylene terephthalate (PETE or PET), polyethylene (PE), polyvinyl Chloride (PVC), polypropylene (PP), polystyrene (PS), polylactic acid (PLA), polycarbonate (PC), acrylic (PMMA), or composites or combinations thereof.

19. The system as claimed in claim 12, wherein the pinion is driven by an electric stepper motor.

20. The chamber as claimed in claim 1, wherein the flexible portion is absent any circumferential bend between the central region and the peripheral region.

* * * * *